US009670938B2

(12) United States Patent
Beliavsky

(10) Patent No.: US 9,670,938 B2
(45) Date of Patent: Jun. 6, 2017

(54) METHOD AND DEVICE FOR TRANSFER OF ENERGY

(71) Applicant: Yan Beliavsky, Maalot (IL)

(72) Inventor: Yan Beliavsky, Maalot (IL)

(73) Assignee: P.G.W. 2014 Ltd. (IL)

( * ) Notice: Subject to any disclaimer, the term of this patent is extended or adjusted under 35 U.S.C. 154(b) by 126 days.

(21) Appl. No.: 14/407,752

(22) PCT Filed: Jun. 13, 2013

(86) PCT No.: PCT/IL2013/000057

§ 371 (c)(1),
(2) Date: Dec. 12, 2014

(87) PCT Pub. No.: WO2013/186770

PCT Pub. Date: Dec. 19, 2013

(65) Prior Publication Data

US 2015/0152886 A1 Jun. 4, 2015

Related U.S. Application Data

(60) Provisional application No. 61/659,680, filed on Jun. 14, 2012.

(51) Int. Cl.
*F25B 9/00* (2006.01)
*F04F 7/00* (2006.01)
(Continued)

(52) U.S. Cl.
CPC ..... *F04F 7/00* (2013.01); *F25B 9/04* (2013.01); *F25B 9/145* (2013.01)

(58) Field of Classification Search
CPC ..... F25B 2309/14; F25B 2309/1401; F25B 2309/1402; F25B 2309/1403;
(Continued)

(56) References Cited

U.S. PATENT DOCUMENTS 1,952,281 A 3/1934 Ranque
4,398,398 A 8/1983 Wheatley et al.
(Continued)

FOREIGN PATENT DOCUMENTS

CN 1235224 A 7/1999
JP 200527400 A 10/2005
(Continued)

OTHER PUBLICATIONS

A. Azarov, "Vortex Tubes: from the Ranque Effect to the Ranque Effect," http://att-vesti.narod.ru/J23-2.HTM, 2007.
(Continued)

*Primary Examiner* — Ryan J Walters
*Assistant Examiner* — Erik Mendoza-Wilkenfel
(74) *Attorney, Agent, or Firm* — Blank Rome LLP

(57) ABSTRACT

A method and device for transfer of thermal energy is described which comprise providing a vessel with a compressible fluid medium, subjecting the compressible fluid medium to a pressure gradient and exposing the compressible fluid medium to sound waves capable to induce fluctuations of density accompanied by establishing of pressure gradient waves propagating through the compressible fluid medium and transferring the thermal energy.

15 Claims, 9 Drawing Sheets

(51) Int. Cl.
*F25B 9/04* (2006.01)
*F25B 9/14* (2006.01)

(58) Field of Classification Search
CPC ..... F25B 2309/1404; F25B 2309/1405; F25B 2309/1411
See application file for complete search history.

(56) References Cited

U.S. PATENT DOCUMENTS

| | | | | |
|---|---|---|---|---|
| 4,722,201 | A | 2/1988 | Hofler et al. | |
| 6,164,073 | A | 12/2000 | Swift et al. | |
| 7,347,053 | B1 * | 3/2008 | Haberbusch | F25B 9/145 62/49.2 |
| 2006/0150643 | A1 | 7/2006 | Sullivan | |
| 2006/0225435 | A1 * | 10/2006 | Arman | F25B 9/145 62/6 |
| 2013/0042600 | A1 | 2/2013 | Gerlach et al. | |

FOREIGN PATENT DOCUMENTS

| | | | |
|---|---|---|---|
| RO | 122506 | B1 | 7/2009 |
| RU | 2067266 | C1 | 9/1996 |
| RU | 2462301 | C1 | 9/2012 |
| WO | WO-9617212 | A1 | 6/1996 |
| WO | WO-03095890 | A1 | 11/2003 |
| WO | WO-2010059751 | A2 | 5/2010 |

OTHER PUBLICATIONS

European Search Report for European Application No, 13803934.2 dated Jan. 21, 2016, 7 pages.

* cited by examiner

METHOD AND DEVICE FOR TRANSFER OF ENERGY

REFERENCE DATA

The present application is a national stage of PCT/IL2013/000057, filed Jun. 13, 2013, which claims priority of the U.S. Patent Application No. 61/659,680 filed Jun. 14, 2012. The content of those applications are hereby incorporated by reference.

FIELD AND BACKGROUND OF THE INVENTION

The present invention refers to transfer of energy associated with heat exchange The present invention is based on a physical phenomenon, which will be referred-to and explained further as Pressure Gradient Waves or briefly PGW phenomenon. In brief the claimed invention is based on a concept that energy transfer takes place within a compressible fluid medium confined within a vessel due to propagation of elastic Pressure Gradient Waves, which are induced in the fluid medium.

In accordance with the present invention the Pressure Gradient Waves emerge and propagate through compressible fluid medium when there is a pressure gradient inside the compressible fluid medium and while inducing therein fluctuations of density.

As a suitable compressible fluid medium one can use gas or mixture of liquid with gas. The pressure gradient can be applied by different means, for example it can be gravitational pressure gradient, or a dynamic gradient due to forcible rotation, acceleration, deceleration of the fluid medium or due to influence of electromagnetic field on ionized fluid medium. The density fluctuations within the fluid medium could be induced by applying sound waves or by induced turbulence.

The pressure gradient results in establishing within the vessel a high pressure zone and a low pressure zone. The energy transfer results in heating the high pressure zone and cooling the low pressure zone. This phenomenon eventually could be utilized either as such for direct heating or cooling of a fluid medium or, in some applications, be subsequently converted into kinetic energy of the fluid medium and then into electric energy.

The present invention can be used in various domestic and industrial applications like refrigerators, heat pumps, cooling systems, air conditioners, energy producing plants, desalination plants, etc. One should bear in mind however that list of possible applications is not limited merely by the above-mentioned examples and that other possible applications of the Pressure Gradient Waves could be contemplated as well.

DESCRIPTION OF THE PRIOR ART

It is known that if air is admitted tangentially and at high pressure into a tubular vessel then warming near the walls of the vessel and cooling at the axis of the vessel is observed. This phenomenon takes place without the help of any movable mechanical organ and it is known as so-called Ranque-Hillsch effect. This effect was discovered in 1930 and it is described for example in U.S. Pat. No. 1,952,281 as method and apparatus for obtaining from a fluid under pressure two currents of fluids at different temperatures. Since then various devices implementing this phenomenon were devised. This group of energy transfer devices is known as vortex tubes. The vortex tubes are employed in very different applications, where cooling or heating is required.

In RO122506 is described ecological conditioning installation functioning on the basis of Ranque-Hillsch effect.

In WO2010059751 are described methods and systems for dissociation of water molecules, which allow separation of hydrogen ions from oxygen ions with the aim of the vortex tube and an electrostatic field.

Many other possible applications of the Ranque-Hillsch effect are described for example in an article by A. Azarov "Vortex tubes: from the Ranque effect to . . . the Ranque effect", which can be found in the Internet on the page: http://att-vesti.narod.ru/J23-2.HTM.

On the other hand there is known also a group of so-called thermo acoustic devices, which functioning is based on exposing a fluid medium to pressure oscillations induced by sound wave with the accompanying adiabatic temperature oscillations. Among possible applications of thermo acoustic devices one can mention heat pumps and cooling engines.

In U.S. Pat. No. 4,398,398 is disclosed acoustical heat pumping engine employing a tubular housing with a compressible fluid capable of supporting an acoustical standing wave. The engine comprises also an acoustical driver disposed at one end of the housing while the other end is capped. A second thermodynamic medium is disposed in the housing near to but spaced from the capped end.

In U.S. Pat. No. 4,722,201 is described acoustic cooling engine provided with a compressible fluid confined within a resonant pressure vessel. The compressible fluid is capable to support an acoustic standing wave. A thermodynamic element is provided, which is located within the vessel and is in thermal communication with the fluid. An acoustic driver is provided which cyclically drives the fluid with an acoustic standing wave.

In JP2005274100 is described heat acoustic device and heat acoustic system.

In CN1235224 is disclosed acoustic wave defogging method and apparatus.

In US2013042600 is disclosed sound attenuating heat exchanger for an internal combustion engine.

In RU2462301 is disclosed device for heat-mass-power exchange between powdered solids, liquids, gases, suspensions, dispersions etc. This device comprises separate pressure chambers communicating via tangential grooves with respective vortex tubes. The vortex tubes communicate via resonant sound holes such that possibility for control of resonant excitation is provided.

Thus one would appreciate that various attempts to devise a device for energy transfer have been undertaken. Those attempts were implemented either as traditional vortex tube or as traditional thermo acoustic device.

It would be desirable, however, to devise a new and improved device for energy transfer, which would be suitable both for domestic and industrial applications and which would combine technical features and advantages associated with each group of the above-mentioned energy transfer devices.

SUMMARY OF THE INVENTION

The above mentioned object is achieved by virtue of the present invention, which can be implemented as a method and as a device for energy transfer. In one embodiment referring to the method it comprises creating within a compressible fluid medium of a pressure gradient and simultaneously establishing within the fluid medium of fluctuations of density resulting in emerging elastic Pressure Gradient Waves. The PGW propagate through the fluid medium and transfer energy, which eventually results in heating of a zone with a high pressure and cooling of a zone with a low pressure.

As suitable compressible fluid one can use a gas or mixture of gas and liquid. It is advantageous if hydrogen or a mono atomic gas, e.g. helium, argon or other inert gas is employed as compressible fluid medium.

The pressure gradient can be obtained by different means, e.g. by relative rotational motion of the fluid medium confined in a vessel such that centrifugal forces would be applied thereto and a low-pressure zone would be near the axis of rotation, while the zone of high pressure would be at the periphery of the vessel. To achieve this one can either rotate the fluid medium within the vessel, or the vessel itself.

The pressure gradient can be created also by passing the fluid medium through a curvilinear channel e.g. spiral channel.

The pressure gradient can be created by urging the fluid medium to pass through a narrowing or expanding channel or nozzle such that the fluid medium accelerates or decelerates.

The pressure gradient can be achieved when the jets of fluid medium impact on an obstacle.

The pressure gradient can be achieved in the channel when there exists viscous friction between the fluid and the channel walls during passing the fluid medium therethrough.

For achieving fluctuations of density in the fluid medium one should use suitable generator which would be capable of inducing initial elastic oscillations in the fluid medium. An example of such generator could be generator of sound waves (including infrasound and ultrasound waves). The advantage of sound waves is the possibility for easy and convenient control the initial elastic oscillations induced in the fluid medium. This could be achieved for example, by changing amplitude and/or frequency of the sound waves.

The means for inducing starting elastic oscillations can be energized by an independent source of energy. For example, it may be a speaker (horn, siren), powered by electricity.

Initial elastic oscillations can be generated by forcible rotating of mechanical elements similarly to producing mechanical sound sirens.

Furthermore, gas jets obtained in whistles or in hoots also can be used for inducing fluctuations of density in the fluid medium.

The sound response is one of the most important factors which can be used for improving the efficiency of energy transfer, since the amount of energy carried by the PGW depends on the amplitude of initial elastic oscillations. At resonance conditions, when the frequency of elastic oscillations coincides with the natural frequency of the vessel inner volume, a standing wave arises and the amplitude of elastic wave increases dramatically. Thus, at resonance conditions, the intensity of Pressure Gradient Waves is larger.

In an embodiment of the present invention referring to a device it is required that both the supply and the evacuation of heat energy would be possible. To accomplish this it is preferable that within the device would be defined two regions: one for supply of a fluid to be cooled and the other one for supply of a fluid to be heated.

Here, the region is either a part of the device which is delimited physically by walls, or it could be a region which is not separated by walls, but nevertheless is under either low or high pressure.

PGW always carries the energy to a strictly defined direction: from the zone of low pressure to the zone of high pressure. Therefore, the fluid to be cooled should be supplied to the region of low pressure, and the fluid to be heated should be supplied to the region of high pressure.

If the claimed device is intended solely for heating solely for cooling of a surface, then merely a single fluid can be employed.

A pressure gradient is created and the source of initial elastic oscillations is positioned inside a vessel filled with a compressible fluid medium.

Pressure Gradient Waves ensure transfer of heat to the region of high pressure while cooling the surface situated in the zone of low pressure and heating the vessel wall placed in the region of high pressure. To evacuate heat from the vessel wall its outside surface should be in contact with the fluid to be heated. The fluid to be cooled is not required if the claimed device is intended only for cooling of a surface.

The compressible fluid medium situated within the vessel can mix or does not mix or not with the fluid medium intended for cooling or heating. Those mediums can be three different substances.

To establish energy transfer by the Pressure Gradient Waves there is no need in temperature gradient and therefore the temperature of fluid medium to be cooled could be kept below or be equal to the temperature of the fluid to be heated.

By virtue of employment of a gas as a compressible fluid medium the energy transfer device can operate within any temperature range. For example one could contemplate using of liquefied gas which would be cooled to even lower temperatures.

On the other hand the upper limit for heating is defined by properties of construction materials selected for manufacturing the device. In other words, by selecting of proper materials and by providing thermal insulation, the energy transfer device of the present invention can operate as a heat pump either at very low or at very high temperatures and either in heating mode or in refrigerating mode depending on particular application.

In a further embodiment the energy transfer device of the present invention could be devised as a tubular vessel provided with pipes branching from the vessel. The branching pipes have one of their ends blind, e.g. plugged or closed by a cover. The opposite end is open to provide communication with the vessel interior. Within the pipes the fluid medium is warmed even more. If the compressible fluid medium and the fluid medium to be heated is the same substance, it is possible to intensify the heat transfer by providing small holes in the blind ends of the pipes or in the periphery wall of the vessel. The holes should allow thermal contact between compressible fluid medium and the fluid medium to be heated. To ensure this, a pressure outside the blind ends is lower than pressure at the high pressure zone. The sizes of holes and their number are selected empirically to satisfy the following condition. The flow rate through the holes should not be too large, to avoid reducing of pressure in the vessel. On the other hand, to intensify heat evacuation the flow rate should be increased. Compressible fluid medium should be admitted to the vessel to compensate loss of the compressible fluid medium through the holes. For this purpose one could use e.g. an external blower or rotating impeller or any other swirling means.

In a still further embodiment the holes made in the blind ends of the branching pipes can be used for removal of moisture from the compressible fluid medium. For this purpose an additional periphery wall which delimits an additional second annular space could be arranged outside the holes made in the blind ends. When the fluid to be heated passes through the first annular space it evacuates heat from the branching pipes.

In a further embodiment pressure gradient in the compressible fluid medium is achieved by acceleration or deceleration. A nozzle can be used for this purpose. In this embodiment there is provided a partition wall that divides the vessel in two sections: the high pressure section and the low pressure section. At least one nozzle is arranged in the partition wall such that when compressible fluid medium flows through the nozzle from the high pressure section to the low pressure section it accelerates. In this embodiment the energy transfer device comprises also a blower or compressor to circulate the compressible fluid medium. In this embodiment an "inertial" pressure gradient is created due to acceleration or deceleration of the compressible fluid passing through the nozzles. The device can be used ether for cooling or for heating and argon can be used as suitable compressible fluid medium.

An important advantage of this embodiment is the ability to convert energy at any temperature range. For example, boiling water can be used as source of thermal energy and pressure inside the vessel. Jets of superheated steam heated at 120° C.-150° C. would be passing through the nozzles and enter to the low pressure section of the vessel. In this embodiment the fluid medium to be heated would be evacuating heat.

In a still further embodiment it is possible to utilize kinetic energy of an artificially created flow of air which would be converted into electric energy with the aim of a generator.

In still further embodiment of the energy transfer device, an ionized gas or high temperature plasma can be used as a compressible fluid medium and a pressure gradient could be created by electromagnetic fields to increase the heat transfer processes.

DETAILED DESCRIPTION OF PREFERRED EMBODIMENTS

The figures below show schematically possible embodiments of the present invention. The common feature for all those embodiments is that they employ compressible fluid medium confined within a vessel and that they operate when Pressure Gradient Waves are established in the compressible fluid medium.

For achieving this effect the following combination of conditions should be satisfied:

- compressible fluid medium is gaseous;
- compressible fluid medium is exposed to a pressure gradient;
- compressible fluid medium is exposed to elastic sound waves which propagate through the compressible fluid medium and cause initial density fluctuations in the compressible fluid medium eventually resulting in establishing of Pressure Gradient Waves;
- sound waves have frequency, which coincides with resonant frequency of the vessel such that amplitude of the density fluctuations increases.

Figure 1:
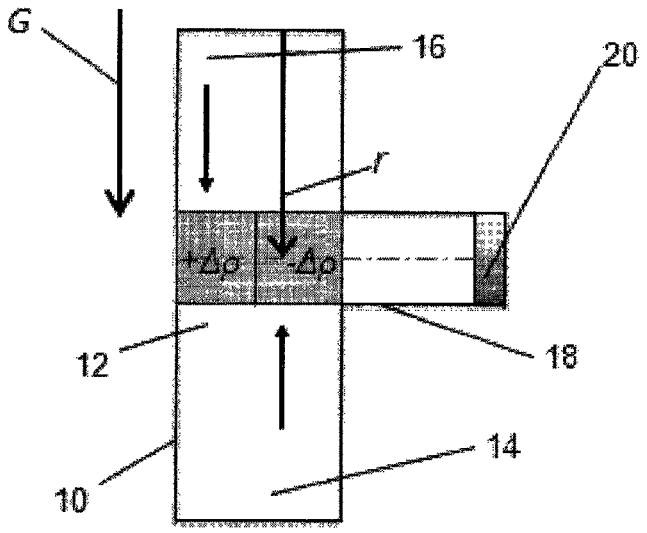
FIG. 1 shows schematically how Pressure Gradient Waves can be established in a device for transfer of energy in accordance with the present invention.

With reference to FIG. 1 the above listed conditions are depicted for the situation when pressure gradient is achieved due to strong gravitation. A suitable set-up is shown, which comprises a vessel 10 filled with a compressible fluid medium 12, e.g. argon. Within the vessel due to gravitational force G a zone 14 is created with increased pressure, and a zone 16 with decreased pressure. A lateral blind branching pipe 18 is provided, which is in fluid communication with the vessel. A generator 20 capable of generating sound waves is arranged within the branching pipe close to its blind end. The generator emanates sound waves towards the vessel such that the compressible fluid medium confined in the vessel is exposed to the standing sound waves, which are defined by the amplitude of sound pressure $+\Delta P$ and $-\Delta P$. It is not shown specifically, but should be appreciated that this set-up comprises also appropriate energy source for energizing the generator as well as appropriate control and instrumentation means for controlling the amount of fluid medium within the vessel and controlling parameters of the sound waves, etc.

Figure 2:
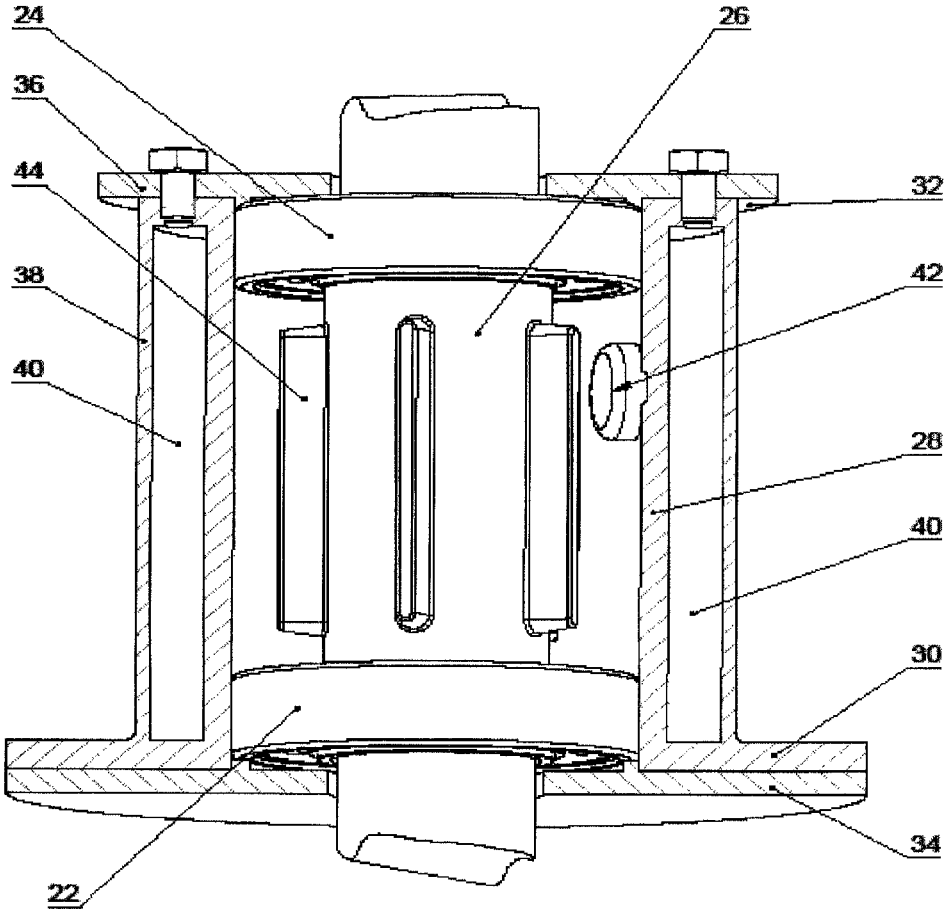
FIG. 2 depicts an embodiment of the energy transfer device of the present invention when it is used for cooling of bearings.

Referring now to FIG. 2 an embodiment of the energy transfer device is very schematically shown, which would be suitable for cooling of high-speed bearings. A couple of bearings, for example ball bearings 22, 24 are secured on a shaft 26 with possibility for rotation for example by a motor (not shown). The shaft is located within a tubular vessel, delimited by a cylindrical peripheral wall 28 and by two opposite flanges 30, 32. The flanges are closed by respective end covers 34, 36 secured on flanges by screws. An external cylindrical wall 38 is provided situated between the covers and coaxially with cylindrical wall 28 is provided, such that there is provided an annular space or gap 40 between wall 28 and wall 38. This space is in fluid communication with a fluid medium intended for heating while evacuating heat from the vessel through periphery wall 28. Such a fluid medium could be water, which is continuously forced to flow in and exit from the annular space. Situated within the vessel and preferably arranged on an inside surface of periphery wall 28 a generator 42 is provided, which is capable of generating sound waves. Inner space of the vessel is delimited by peripheral wall 28 and opposite flanges 30, 32 and it is filled by a compressible gaseous fluid medium, e.g. air. Arranged on the shaft a plurality of narrow blades 44 is provided, which extend longitudinally along the shaft, such that when the shaft is forcibly rotated by an external motor (not shown) a pressure gradient would be established within the vessel.

High-speed ball bearings significantly warm up during operation and therefore they should be cooled. For this purpose a very special and complicated cooling systems usually are employed. The embodiment of the energy transfer device shown in FIG. 2 is intended to simplify the cumbersome conventional cooling systems.

The device operates as follows. The shaft is rotated and blades 44 swirl air flow such that pressure gradient establishes. Maximum of pressure is established at peripheral wall 28 of the vessel and minimum of pressure adjacent the shaft. Generator 42 is activated and interior of the vessel is exposed to sound waves produced by the generator. Eventually Pressure Gradient Waves are established within the vessel, which transfer heat from central region of the vessel to its periphery. By virtue of this provision shaft 26 as well as ball bearings 22, 24 are cooled, while peripheral wall 28 heats. Flow of water continuously passing through annular space 40 evacuates heat from the peripheral wall.

Thus in this embodiment are employed two fluid mediums, which are presented by dissimilar substances. One of them is compressible gaseous fluid medium and the second one is liquid fluid medium. As gaseous fluid medium air is used and it is responsible for heat transfer by virtue of Pressure Gradient Waves, Water functions as fluid medium to be heated due to thermal contact through peripheral wall 28 with the hot high pressure region in the vessel.

Now, with reference to FIG. 3 still further embodiment of the energy transfer device will be explained. In this embodiment the energy transfer device functions as air conditioner for heating or cooling air in dwellings, residential and industrial buildings, premises, etc. The device comprises a supply duct 46, which is in flow communication with a tubular vessel delimited by a cylindrical peripheral wall 48 and by two opposite ends 50, 52. On the end 52 a duct is secured through which air is supplied to a required location in the dwelling after it has passed the vessel. Air is forcibly supplied to the vessel from outside. The air always escapes the vessel after it cools. During warm weather air from the dwelling is urged by the ventilator to enter the device and then upon cooling it is returned to the dwelling. When the weather is cold air is forced to pass the energy transfer device and upon heating it is returned to the dwelling. Ambient air permanently is urged to pass the device and then is exhausted to atmosphere. In summer it reduces the unnecessary heat. In winter it passes the vessel and cools while providing heat for warming. The vessel interior is separated from the supply duct by an impeller means 54 capable of swirling gaseous fluid medium before it enters the vessel. The impeller means can be configured for example as a vent or as a chamber, secured on the end 50 and provided with tangential helically directed slots, which cause swirling of air when it passes through the slots. A second swirling means, e.g. ventilator is provided. This swirling means is located in the vessel and comprises a shaft with blades. Both swirling means are rotated by motors. A second cylindrical peripheral wall 56 is provided. This wall is co-axial with the periphery wall 48 of the vessel and is spaced from it such that an annular space 58 is provided which separates between wall 48 and 56. A plurality of radially directed branching pipes 60 is arranged in the annular space such that one end of branching pipes is in flow communication with the vessel interior, while the opposite end is closed and terminates on periphery wall 56.

Arranged coaxially with the vessel a de-swirling, e.g. a baffle means 64 is provided, which terminates swirling of air when it exits from the vessel. A third cylindrical peripheral wall 66 is provided, which is co-axial with the wall 56 and is spaced from it by an annular gap 68. It is not shown specifically but should be appreciated that flow of air circulates through the annular space 58. Secured inside longitudinal vessel a generator 70 of sound waves is provided, which is capable to emanate sound waves into air within the vessel. The vessel is in flow communication with a second duct 72, secured on the end 52. This duct is in flow communication with a location in the dwelling where chilled or heated air should be supplied.

The energy transfer device comprising the above listed components is installed outside of a dwelling, while ducts are in flow communication with the dwelling.

Figure 3:
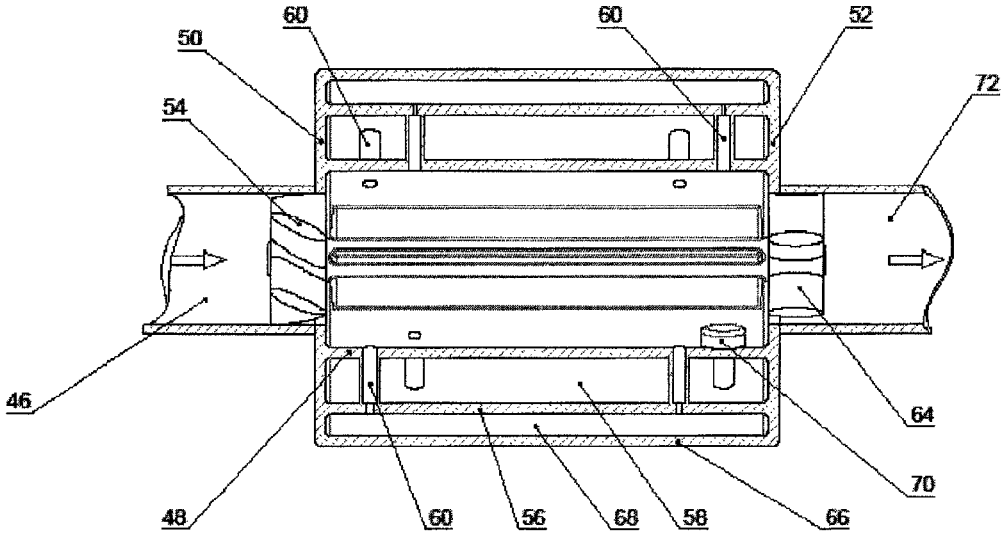
FIG. 3 shows an embodiment of the energy transfer device used for air conditioning.

Consider now operating of the energy transfer device shown in FIG. 3 for delivering chilled air.

Swirling means 54 sucks air from the dwelling via duct 46 and forces it to enter the vessel. Second swirling means keeps the air swirled when it passes through the vessel.

Swirling of air within the vessel creates pressure gradient with maximum pressure at periphery wall 48. Generator 70 emanates sound waves into air within the vessel and upon exposure to the sound waves Pressure Gradient Waves are established, which are responsible for transfer of heat energy to the periphery wall of the vessel. The heat hits the periphery wall and the branching pipes 60, while heating is especially intensive inside the branching pipes. The length and diameter of pipes 60 is selected empirically. Outside air, which flows through annular gap 58, permanently evacuates heat from the pipes. Warm air is sucked from the dwelling, cools inside the vessel and then is returned to the dwelling. Before exiting from the vessel the flow of swirled cold air passes through baffle means 64 rendering the air flow laminar. Moisture partially condenses from the cooled air in the vessel and the drops move to the peripheral wall 48 by the rotation and enter into branching pipes 60. A plurality of small holes could be provided within the pipes to allow collecting of moisture in moisture collecting chamber 62.

The same energy transfer device could operate in heating mode as well i.e. for heating air or water. In this case ambient air would be pumped through duct 46 and upon cooling discharged to atmosphere. Air or water from the dwelling would be pumped through annular gap 58 where it would be heated and then returned to the dwelling.

Figure 4:
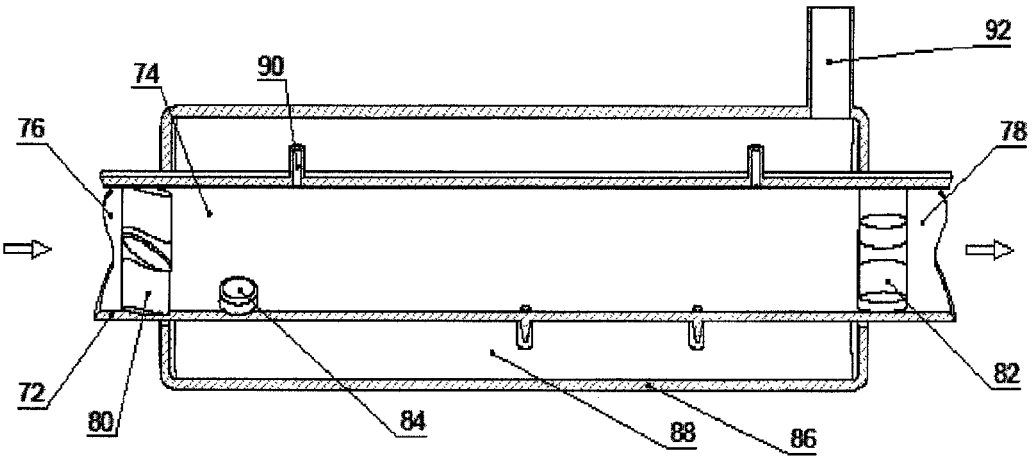
FIG. 4 shows an embodiment of the energy transfer device used for dehydration of a gas.

In a further embodiment depicted in FIG. 4 the energy transfer device is employed for heating and cooling of gases as might be required for example for dehydration of natural gas.

Natural gas from gas fields usually contains a large amount of steam and therefore should be dehumidified. Thus, it is important: first, to minimize the pressure losses, second, to decrease the amount of $H_2S$, which is formed during contact of the gas with water. In practice a device known as Twister tube is used for dehydration of natural gas. This device is described in an article by Peter Schinkelshoek, Hugh D. Epsom: Supersonic Gas Conditioning—Commercialization of TWISTER™ Technology, $87^{th}$ Annual Convention, Grapevine, Tex., USA, Mar. 2-5, 2008. In this device, the natural gas, first, is swirled by a stationary guide vane, and then accelerated to significant velocities by passing it through a narrowing channel. Acceleration is accompanied by decrease of pressure and temperature, and eventually by separation of water vapor which condenses as droplets. The droplets are captured and removed by a droplet separator while they contain only a small amount of gas.

The disadvantages of this device are:

- significant losses of pressure, which is required for acceleration of the gas (an inlet pressure in the Twister tube is 100 bar, when the outlet pressure from the device is 75 bar).
- formation of large amount of undesirable hydrates $H_2S$ due to relatively long contact of the gas with water droplets.

Referring to FIG. 4 it is shown schematically an embodiment of energy transfer device employed for drying of natural gas. This device is configured as elongate tubular vessel 72, defined by a cylindrical periphery wall 74 and by an entrance port 76 and an exit port 78. Natural, humid gas is supplied through the entrance port to the vessel while dehumidified gas exits from the vessel through the exit port. A swirling means 80 is arranged at the entrance port, swirls gas flow before it enters the vessel. As suitable swirling means one can use ventilator or a chamber with helical tangential slots. A de-swirling, e.g. a baffle means 82 is provided, which is arranged before exit port 78 to render the gas flow laminar before it proceeds further. As a suitable baffle means one can use a grid or at least one crosspiece. A generator 84 of sound waves is situated within the vessel;

The generator is energized by appropriate power source and there is provided appropriate instrumentation (not shown) for controlling electrical parameters of the generator and accordingly of the generated sound waves. By virtue of this provision flow of gas passing through the vessel is exposed to the sound waves. A second cylindrical periphery wall 86 is provided, which is co-axial with the wall 74 and is distant there from such that an annular gap 88 separates between wall 74 and wall 86. At least one branching pipe 90 is arranged on the wall 74, such that it protrudes radially into the gap 88. One end of the pipe is in flow communication with the vessel, while an opposite end thereof is closed. Small holes are made in the closed end of branching pipes to allow flow communication with the annular gap.

Situated near the exit port 78 a second exit port 92 is provided for evacuation of a fluid medium from the gap 88.

The energy transfer device in accordance with this embodiment operates as follows.

Natural gas containing steam is admitted to the vessel through entrance port 72 and then proceeds through swirling means 76. Direction of the gas is depicted by arrows. When the gas passes through the swirling means pressure gradient is established in the vessel. The pressure is maximal at the periphery near cylindrical wall 74; while adjacent the vessel axis the pressure is minimal. Before exiting from the vessel the gas flow passes baffle means 82 which renders it laminar.

Generator 84 emanates sound waves into the vessel such that Pressure Gradient Waves are established in the swirled gas flow. Those waves transfer heat energy from central zone of the vessel to the periphery wall 74. Initial sound wave should have a high capacity. This can be achieved by increasing the power supplied to the generator and/or by selecting the resonant frequency, such that it would be equal to the natural frequency of the vessel.

The established PGW cause cooling of central zone of the swirled gas flow and transferring heat to periphery wall of the vessel. Water vapor condenses from the gas inside the vessel and due to swirling water drops are collected on the periphery wall 74 and enter into branching pipes 60. The PGW are absorbed by the periphery wall, which is heated. Furthermore, the PGW enter the branching pipes and heat their interior. The pressure gradient increases pressure at the periphery, which forces gas to flow through branching pipes and further through small holes to the annular gap 88. By virtue of this provision heat is evacuated from the branching pipes. At the same time gas flowing through the gap 88 is heated and is evacuated through port 92. This gas is warmed up to considerable temperatures. Since temperature in the branching pipes is high droplets evaporate and convert into steam. This steam is forced by the gas flow to escape from the branching pipes through exit port 92. It should be appreciated that eventually natural gas in the vessel dries out and becomes dehydrated.

Dimensions of the tubular vessel, as well as quantity, configuration and dimensions of the channels could be established empirically. The embodiment described above could be modified as follows:

- Small holes made in the close end of branching pipes could be located as close as possible, thus increasing their fraction of the total wall area
- Diameter of the vessel can vary.
- Swirling means could be located in the middle region of the vessel.

This embodiment is defined by several advantages, like reduced loss of pressure, reduced amount of residual hydrates, and reduced amount of natural gas which has to be regenerated.

Figure 5:
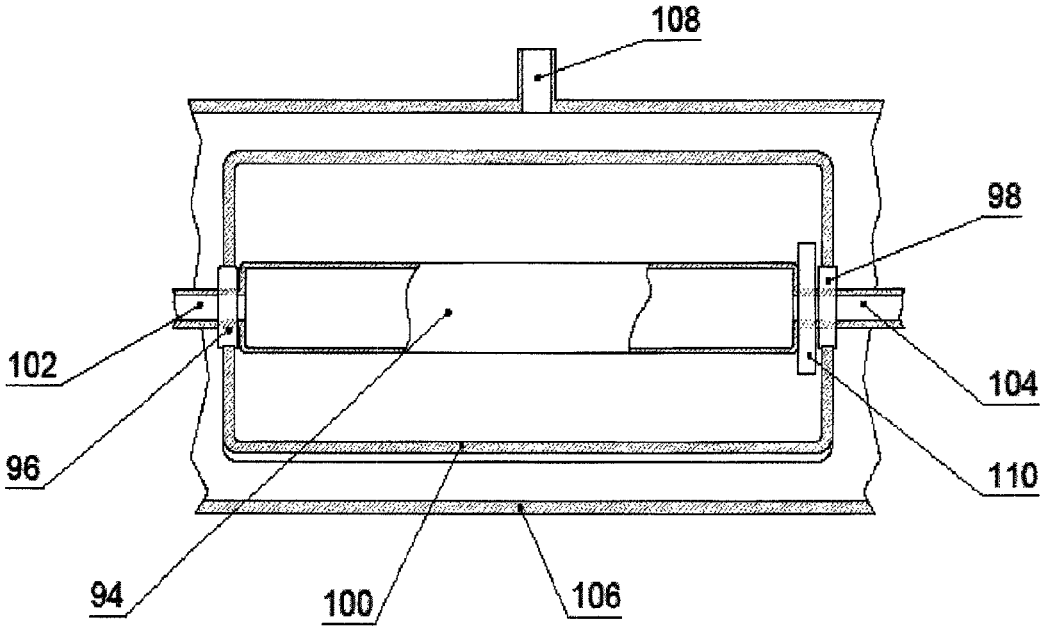
FIGS. 5 and 6 depict schematically an embodiment of the present invention functioning as a heat pump used in a system for desalination of seawater.
Figure 6:
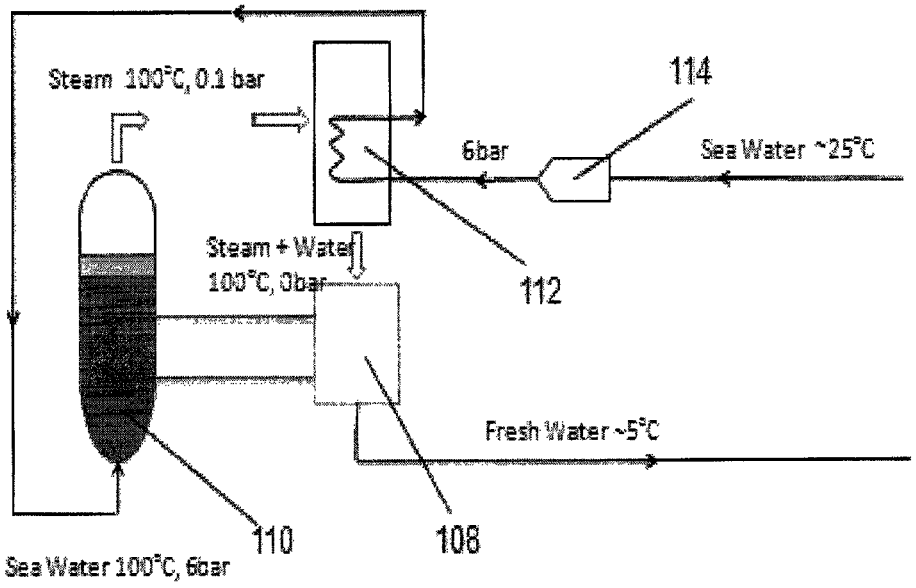

With reference to FIGS. 5 and 6 still further embodiment of the energy transfer device will be know explained. In this embodiment the energy transfer device functions as a heat pump employed in a system for desalination of seawater.

The energy transfer device itself is schematically shown in FIG. 5 while the desalination system in which it is employed is schematically depicted in FIG. 6. The energy transfer device shown in FIG. 5 comprises a first tubular vessel 94 mounted with possibility for relative rotation by virtue of a couple of bearings 96, 98. The first vessel is relatively rotatable with respect to a second tubular vessel 100, which is co-axial with the first vessel. Relative rotation can be accomplished by a motor (not shown). The second vessel is hermetically closed and filled with a compressible fluid medium, e.g. hydrogen. An inlet port 102 is provided at one end of the first vessel while an exit port 104 is provided at an opposite end of the first vessel. Through the inlet port a mixture of steam and fresh seawater is continuously admitted to the first vessel, while the exit port is intended for evacuation of fresh desalinated water from the first vessel. The second vessel is confined within an outside closure 106 having an outlet port 108. A heat exchanger is provided (not shown), in which seawater is heated up to about ~100° C. by hot steam and then hot seawater is fed inside the closure 106, which serves as a boiler.

In this embodiment the device functions as a heat pump for desalination of seawater. The substances intended for use as heat transfer agents and as a compressible fluid medium and materials, from which the device is manufactured, are selected depending on particular application and required temperature range.

A generator 110 of sound waves is provided. This generator is arranged adjacent to exit port 104 and it is located within the first vessel such that when flow of seawater passes through the first vessel it is exposed to sound waves emanated by the generator. Pressure Gradient Waves are established and propagate through compressible fluid medium confined within the second vessel, while seawater is the fluid medium to be heated. Seawater is continuously fed inside annular space between second vessel 100 and closure 106 where it evaporates at a temperature which is slightly more than ~100° C. Before seawater enters in the annular space it is heated in the external heat exchanger by hot steam. The evaporated steam-water mixture at a temperature of ~100° C. enters the first vessel. This mixture serves as fluid medium to be cooled. Pressure Gradient Waves are established in the second vessel and propagate through compressible fluid medium confined within the second vessel while it is rotated.

The wall of the first vessel is cooled by the established PGW such that inside the first vessel steam condenses while producing desalinated water. The obtained desalinated water cooled to a temperature of ~5-10° C. is evacuated from the device.

The heat transferred by the PGW from surface of the first vessel to the periphery wall of the second vessel.

In this embodiment the energy transfer device operates as a heat pump. Its main advantage is that all thermal energy expended for heating and for evaporation of seawater completely returns to the beginning of the cycle. Pressure Gradient Waves transfer to the fluid medium to be heated the same amount of heat, which has been taken away from the fluid medium to be cooled. The plant takes seawater at a temperature, for example, of ~25° C. and produces desalinated water at a temperature of ~5-10° C.

The energy is consumed by this device for energizing the generator of sound waves, for energizing a motor rotating the second vessel, for compensation of losses of energy in the motor, for compensation of friction in the bearings, for energizing of a pump responsible for circulating of fluid medium to be cooled and of a pump responsible for circulating the fluid medium to be heated, for compensation of losses due to friction between second vessel and fluid medium confined in the closure and for compensation of heat losses to surrounding space.

Below are listed some options for reducing the energy losses:

- Configuring the second vessel as an elongated cylinder with diameter to length ratio greater than 1/10;
- Directing the fluid mediums responsible for heating and cooling in opposite directions;
- Providing roughness and ribs to improve heat transfer between metallic surfaces and fluid mediums;
- Using optical film technology to reduce intensity of heat transfer due to thermal electromagnetic radiation;
- Using of powerful sound generators with required frequency and low energy consumption and establishing of sound resonance conditions;
- Creating pressure gradient at a minimal cost.

The energy transfer device described above can be used also as a regular heat exchanger; for example, for utilization of heat in thermal power plants. In this case, the waste gases produced by turbine employed at a power plant would serve as fluid medium to be cooled, and air or air/gas mixture supplied to combustion chamber of a power plant would serve as fluid medium to be heated. There are some other alternatives for creating pressure gradient. For example one can rotate either the second vessel, as explained above or the fluid medium itself. This could be effected by an impeller (not shown in FIG. 4) situated within the second vessel. Still further possibility would be arranging within the second vessel of tangential jets of a fluid medium.

Referring now to FIG. 6 a system for desalination of seawater will be briefly discussed.

The system comprises the following main components: a heat pump 112, which has been explained above, a steam producing column 114 and a heat exchanger 116. Furthermore, an auxiliary pump 118 is provided for pumping seawater into heat exchanger. All main components of the system, i.e. heat pump, heat exchanger and steam producing column are in flow communication with each other.

The system operates as follows. Seawater fed into heat exchanger at about room temperature where it is heated and then proceeds into steam producing column. The steam produced in the column is heated up to ~100° C. and has pressure of about 0.1 bar. This steam is supplied to heat exchanger 116 for heating fresh portions of seawater pumped by auxiliary pump 118. Part of the steam is condensed and steam water mixture at a temperature of ~100° C. and pressure of 0 bar proceeds to the first tubular vessel provided in the heat pump. A portion of fresh seawater at a temperature of ~100° C. is fed also to the outside closure of the device. Desalinated, cold, fresh water is evacuated from the heat pump at ~5-10° C.

Figure 7:
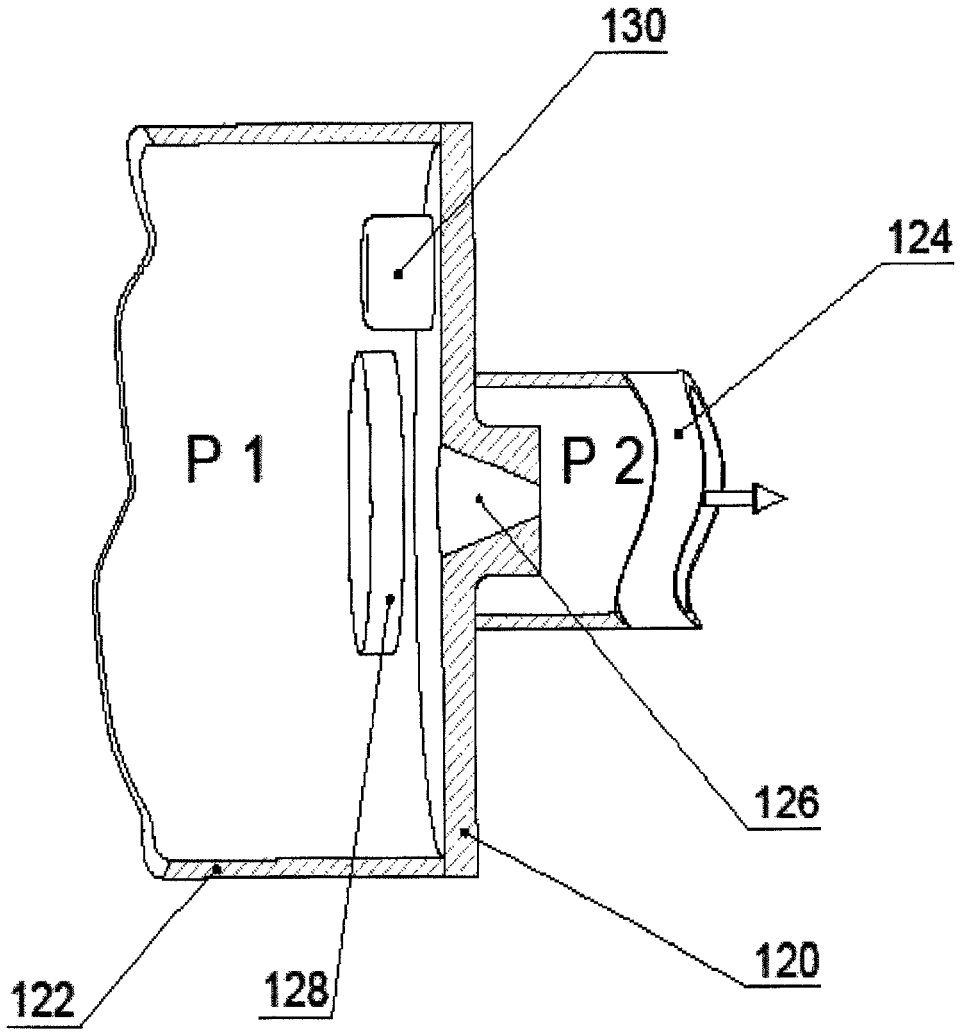
FIGS. 7 and 8 show a fragment of device for transfer of energy employing a nozzle for creating gradient of pressure.

Now with reference to FIG. 7 it will be explained how pressure gradient can be achieved in the energy transfer device by alternative means. In this embodiment the energy transfer device is intended for heating or cooling of a fluid medium that can be either liquid or gas. An example of such application would be conditioning of air.

In this embodiment so-called "inertial" pressure gradient is created by acceleration of compressible fluid medium when it passes a nozzle and not by a swirling means. The other features of the energy transfer device remain similar to those explained earlier. In this embodiment the energy transfer device comprises a partition wall 120 separating between a closed volume 122 filled with air and a duct 124 through which air is supplied to the dwelling upon cooling. The closed volume could be configured as a vessel, a receptacle, a tank or a reservoir. The energy transfer device is located outside the dwelling and supplies cold air to the dwelling. At least one nozzle 126 is arranged within the partition wall such that flow communication between closed volume 122 and duct 124 would be possible. It should be appreciated that in this embodiment the closed volume and the duct together constitute a vessel, in the sense as it has been mentioned earlier in connection with the previous embodiments.

It is preferable that the nozzle is configured such that it converges towards the duct and diverges towards the closed volume. By virtue of this provision when air passes through the nozzle it accelerates and a zone of high pressure P1 establishes in the closed volume and a zone of low pressure P2 is established in the duct, while P1>P2. A heat exchange screen 128 is provided, through which circulates fluid medium to be heated (not shown) such that heat exchange with the air confined in the closed volume 122 would be possible. A generator 130 of sound waves is provided within the closed volume such that air passing through the nozzle is exposed to sound waves when they are emanated by the generator.

The energy transfer device operates as follows. Upon energizing the generator and producing of sound waves there are established Pressure Gradient Waves in the air flowing from the closed volume into duct. The PGW transfer heat of the flowing air towards the zone of high pressure where the heat is absorbed by heat exchange screen. The fluid to be heated (for example water) circulates inside the screen and evacuates heat from the closed volume. The air passing through the nozzle to the zone of low pressure is cooled and proceeds to the dwelling.

In this embodiment direction of heat transfer carried out by Pressure Gradient Waves is opposite to direction of air flow which upon cooling is supplied to the dwelling. It is not shown specifically, but should be appreciated that air supplied to the dwelling is returned from the dwelling back to the closed volume, e.g. by compressor or blower (not shown).

Figure 8:
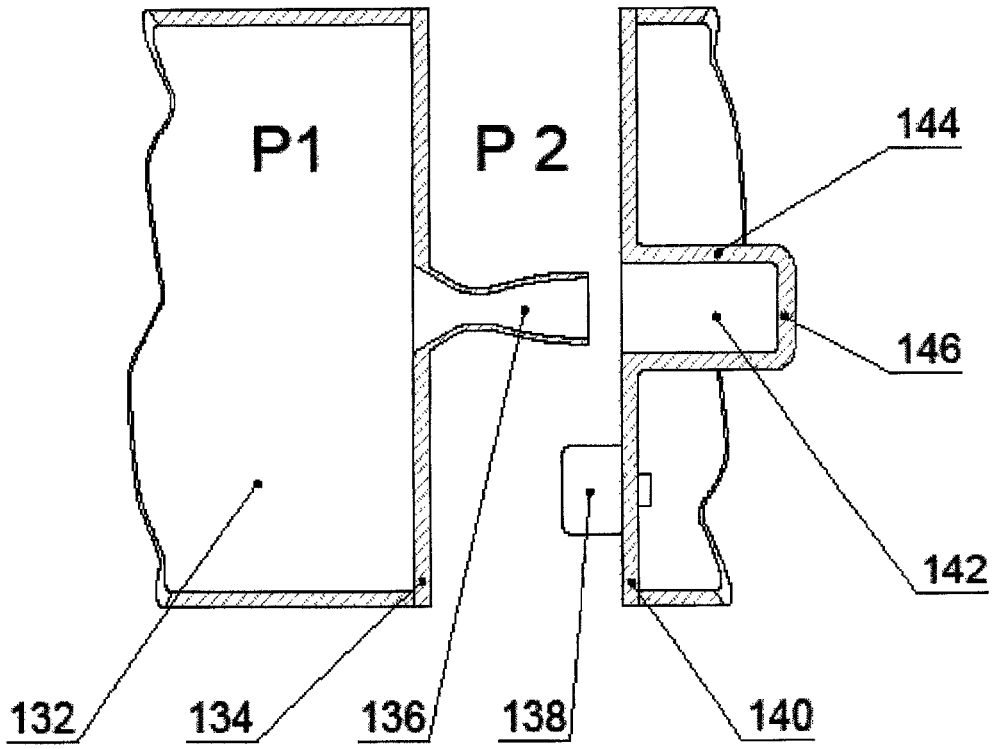

Still further embodiment of the energy transfer device employing a nozzle for obtaining pressure gradient will be explained with reference to FIG. 8. This embodiment can be used for heating of air. In general it comprises similar components. Among those components is a closed volume 132 filled with a compressible fluid medium, a partition wall 134, delimiting the closed volume, at least one nozzle 136, providing and a generator 138 capable to produce sound waves. However, the nozzle employed in this embodiment is configured differently, namely as de Laval nozzle in the sense that the nozzle has asymmetric shape defined by a converging inlet section and by a diverging exhaust section. Furthermore there is provided also a second partition wall 140 with arranged thereon at least one branching pipe 142. The branching pipe is defined by a lateral wall 144 and by a rear wall 146. The closed volume is filled with pressurized gas, e.g. argon, which in this embodiment is used as compressible fluid medium and at the same time as fluid medium to be cooled. A zone of a first pressure P1 of about 6 bars is provided within the closed volume and a zone of a second pressure P2 of about 0.5 bars is provided in the region confined between the first partition wall and the second partition wall. When argon flows through the nozzles it accelerates and enters inside branching pipe. A pressure gradient establishes due to deceleration of argon flow when it meets rear wall of the branching pipe. Kinetic energy of argon flow is converted into potential energy and pressure in the branching pipe 142 increases to a maximum at the rear wall. Pressure Gradient Waves are established inside the branching pipe 142 upon producing sound waves by the generator 138. The PGW submit heat to rear wall of the branching pipe. The heat is taken from argon from the zone of low pressure such that it cools. The fluid medium to be heated (for example, air) can be admitted for evacuating heat from the rear wall. The cooled argon removed from the zone of low pressure proceeds to heat exchanger and compressor (not shown) before it is returned to the closed volume.

When argon flows inside the nozzles towards the zone of low pressure it accelerates and inside the nozzles also establishes gradient of pressure, which could cause transfer of heat in the opposite direction, thereby deteriorating the efficiency of the device. To avoid this, the flow of gas inside the nozzles should be rendered supersonic. In practice de Laval nozzles should be preferably employed in this situation and ratio of pressures $P_2$ and $P_1$ should be kept as $P_2/P_1<0.5$.

The advantage of energy transfer device in accordance with the last two embodiments is simplicity and absence of moving parts. Still further advantage is possibility for transfer of heat energy at any temperature range. For example, boiling water can be employed as suitable source of thermal energy and pressure. In this situation flow of superheated steam at 120° C.-150° C. will be passing the nozzles and enter in the branching pipes. The fluid medium to be heated (gas) will be heated up to 800° C. Referring now to FIG. 8 still further embodiment of the present invention will be described.

In this embodiment thermal energy of an artificially created air vortex is converted subsequently into kinetic energy and further into electrical energy.

Figure 9:
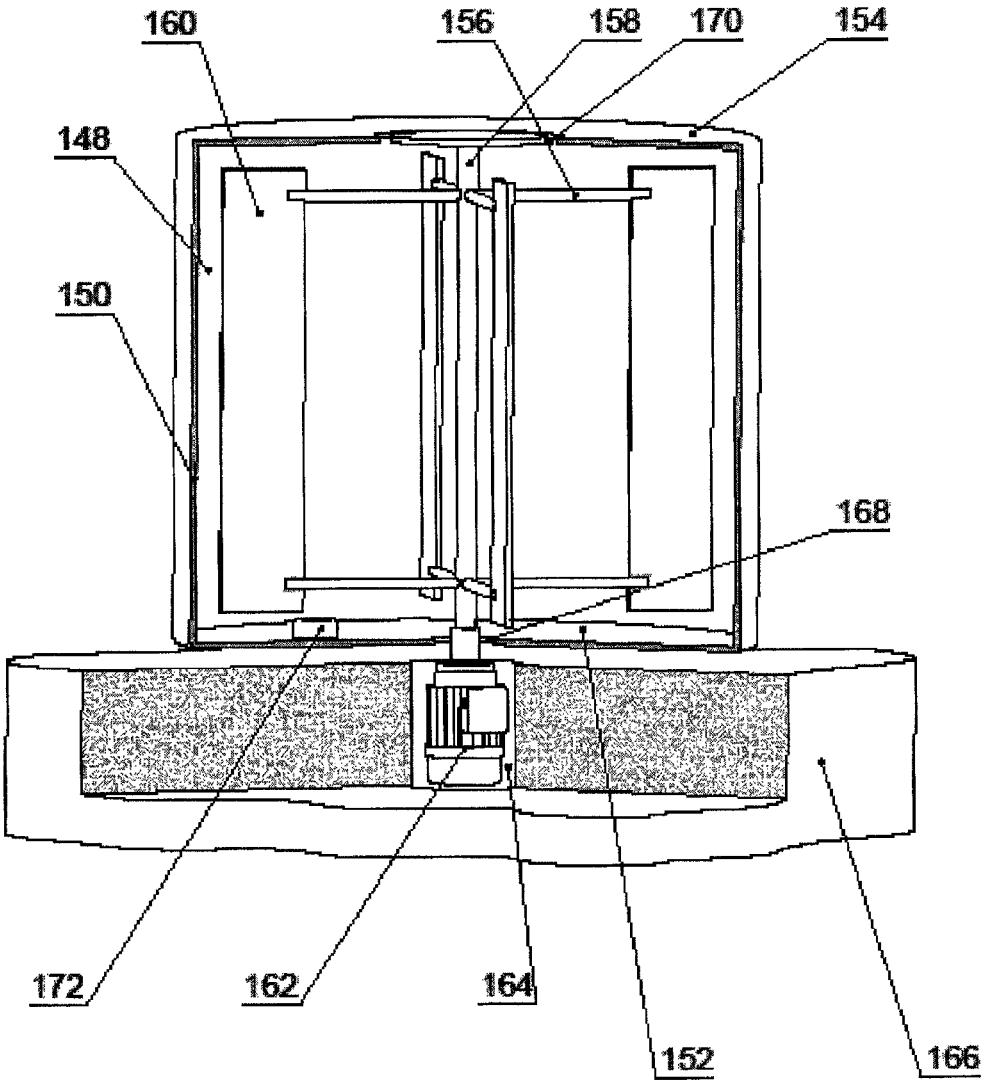
FIG. 9 shows an embodiment of the present invention used for generation of electrical energy.

Referring to FIG. 9 this embodiment comprises a tubular vessel 148 delimited by a cylindrical periphery wall 150, by a bottom wall 152 and by an upper wall 154. Confined within the vessel a turbine 156 is provided, which has a vertically directed shaft 158 with secured thereon blades 160. The turbine is located within the vessel with possibility for forcible rotation by a motor/generator 162. The motor/generator is situated outside of the turbine being secured within a depression 164 provided in a basement 166. A circular inlet opening 168 is provided at central zone within bottom wall 152 of the vessel to allow mechanical connection between lower end of the shaft and the motor/generator and at the same time to allow outside air to enter in the vessel. An annular outlet opening 170 is provided in the upper wall to allow rotation of the shaft and exit of air. A generator 172 capable of producing sound waves is provided. The generator is located within the vessel being situated such that air within the vessel would be exposed to sound waves emanated by the generator.

The energy transfer device according to this embodiment operates as follows. Motor/generator 162 is energized and is switched in a motor mode so as to forcibly rotate blades 160. Blades 160 would swirl air within the vessel and create pressure gradient such that near the shaft pressure is minimal while at the periphery wall pressure is maximal. Fresh portions of ambient air would be sucked inside the vessel through the inlet opening. Generator 172 is switched on to produce sound waves, which would propagate through the air while inducing density fluctuations and eventually establishing of Pressure Gradient Waves. This would result in a heat transfer accompanied by cooling the air situated in vicinity of shaft 158 and heating air situated in vicinity to periphery wall 150. The PGW would be propagating through the air and be absorbed by periphery wall 150 such that heat energy would be converted into kinetic energy causing formation of air vortex assisting to rotate the turbine. Eventually motor/generator 162 would be switched into generator mode to produce electrical energy due to forcible rotation by the air vortex. One should bear in mind that amount of produced electrical energy would be less than the amount of converted heat energy because of unavoidable heat losses, friction losses and conversion coefficient of the generator. Rotational movement of air within the vessel is associated with increase of pressure from center of the vessel to its periphery. Therefore radius of the inlet opening should be less than radius of the outlet opening such that pressure at the exit from the vessel would be more than ambient pressure. If this condition is satisfied ambient air will be sucked into inlet opening and then upon passing central region of the vessel it will be involved into rotational movement and then exit from the vessel via the outlet opening, while being significantly cooled. The PGW transfers heat energy from central region to the periphery and heats the periphery wall of the vessel.

It should be appreciated that the present invention is not limited by the above described embodiments and that one ordinarily skilled in the art can make changes and modifications without deviation from the scope of the invention as will be defined below in the appended claims.

It should also be appreciated that features disclosed in the foregoing description, and/or in the foregoing drawings, and/or examples, and/or tables, and/or following claims both separately and in any combination thereof, be material for realizing the present invention in diverse forms thereof.

When used in the following claims the terms "comprise", "contain", "have" and their conjugates mean "including but not limited to".

The invention claimed is:

1. A method for transfer of thermal energy comprising:

providing a vessel with a compressible fluid medium confined therein;

subjecting the fluid compressible medium to a pressure gradient and establishing in the vessel a zone with a high pressure and a zone with a low pressure, wherein said pressure gradient is achieved by rotation of the compressible fluid medium;

exposing the compressible fluid medium to sound waves accompanied by fluctuations of density wherein said fluctuations of density capable to induce in the compressible fluid medium of a pressure gradient waves, propagating through the compressible fluid medium along a pressure gradient vector and propagating of the pressure gradient waves is associated with transferring the energy from the zone of low pressure to the zone of high pressure and the zone of low pressure is associated with a low temperature while the zone of high pressure is associated with a high temperature.

2. The method of claim 1, wherein said sound waves are selected from the group consisting of sound waves, ultrasound waves and infrasound waves.

3. The method of claim 2, wherein said sound waves have frequency, which is equal to a resonant frequency of the vessel.

4. The method of claim 1, wherein said compressible fluid medium is selected from the group consisting of a gas and of a mixture of a gas and a liquid.

5. The method of claim 4, wherein said gas is selected from the group consisting of hydrogen, helium and argon.

6. The method of claim 4, wherein said compressible fluid medium is air.

7. The method of claim 1, wherein said pressure gradient is effected by subjecting the compressible fluid medium to influence of a pressure gradient source selected from the group consisting of gravitation, swirling, passing through a nozzle, passing through a channel and an electromagnetic field.

8. The method of claim 1, wherein the thermal energy is evacuated from and supplied to the vessel by a fluid medium, intended either for heating or for cooling.

9. A device for transfer of energy comprising:

a vessel containing a compressible fluid medium, wherein said compressible fluid medium is selected from the group consisting of a gas, a mixture of a gas and a liquid, an ionized gas and plasma, and wherein said vessel is configured as a tubular member having a first periphery wall adjacent to the zone of high pressure and a second periphery wall, which surrounds the first periphery wall such that a space is provided therebetween, and said space is filled with a fluid medium to be heated circulating through the space;

a pressure gradient source suitable for creating in the vessel a zone in which compressible fluid medium is under a high pressure and a zone in which compressible fluid medium is under a low pressure, wherein the pressure gradient source is selected from the group consisting of gravitation, a swirling means, a nozzle, a channel and an electromagnetic field;

a generator of sound waves suitable to induce fluctuations of density in the compressible fluid medium, wherein said fluctuations of density are followed by establishing of pressure gradient waves propagating through the compressible fluid medium along a pressure gradient vector and propagation of the pressure gradient waves is associated with transfer of energy from the zone of low pressure to the zone of high pressure and the zone of low pressure is associated with a low temperature while the zone of high pressure is associated with a high temperature, and further wherein said generator of sound waves is situated within the vessel such that the compressible fluid medium would be exposed to the generated sound waves, wherein said swirling means for said compressible fluid medium rotation are selected from the group consisting of a chamber with tangential helically slots, rotating said vessel itself, rotating said fluid medium within the vessel using blades, an impeller, a ventilator.

10. The device of claim 9, wherein said device is further provided with at least one branching pipe, secured on the first periphery wall and directed towards the second periphery wall, and said at least one branching pipe has a first end which is in fluid communication with the vessel, and a second end which is closed.

11. The device of claim 9, wherein said compressible fluid medium is gas and said device is provided with a duct for admitting the gas in the vessel and with a swirling means for swirling the gas before admitting thereof in the vessel, said device comprises a second duct for exit of cold, dried gas from the vessel, and wherein the space is in fluid communication with an external volume and said device is further provided with at least one branching pipe directed towards the second periphery wall, said at least one branching pipe having a first end which is open to provide fluid communication with the vessel and said at least one branching pipe has a second end having at least one hole to provide fluid communication with the annular gap and said generator of sound waves is situated within the vessel such that the gas would be exposed to the generated sound waves.

12. The device of claim 9, comprising a first tubular vessel filled with a fluid medium to be cooled, said first tubular vessel is associated with the zone of low pressure, and a second tubular vessel filled with the compressible fluid medium, the first vessel is co-axial with the second vessel and said device having a swirling means for rotation of the compressible fluid medium, said device further comprising an outside closure surrounding the second vessel and wherein the first vessel is provided with an inlet and with an outlet port for evacuating the fluid medium to be cooled and said outside closure is provided with an inlet port for admitting a fluid medium to be heated and with an outlet port for evacuating a fluid to be heated wherein said generator of sound waves is situated within the second tubular vessel such that the compressible fluid medium within the second vessel would be exposed to the generated sound waves.

13. The device of claim 9, comprising a de-swirling means.

14. The device of claim 13, wherein said de-swirling means comprises at least one crosspiece.

15. The device of claim 9, wherein said nozzle is selected from the group consisting of a converging nozzle, a cylindrical nozzle, a diverging nozzle and de Laval nozzle.

* * * * *